United States Patent [19]

Fordyce et al.

[11] 4,063,840

[45] Dec. 20, 1977

[54] EXPANSION JOINT SEAL ASSEMBLY

[75] Inventors: Gary L. Fordyce; Richard D. Hein, both of Wabash, Ind.; Fred V. Sandels, Hartville; James E. Britton, Akron, both of Ohio

[73] Assignee: The General Tire & Rubber Company, Akron, Ohio

[21] Appl. No.: 775,819

[22] Filed: Mar. 9, 1977

[51] Int. Cl.[2] ..... E01C 11/12

[52] U.S. Cl. ..... 404/69; 52/396; 14/16.5; 49/475

[58] Field of Search ..... 404/69, 68, 47; 52/396, 52/309.1; 14/16.5; 49/475

[56] References Cited

U.S. PATENT DOCUMENTS

| | | | |
|---|---|---|---|
| 2,220,628 | 11/1940 | Stedman | 404/47 |
| 3,316,574 | 5/1967 | Pare | 404/47 |
| 3,570,378 | 3/1971 | Honegger | 404/69 |
| 3,713,368 | 1/1973 | McDowell | 404/69 |
| 3,887,292 | 6/1975 | Koster | 52/396 X |
| 3,899,261 | 8/1975 | Mieville | 404/68 |
| 3,981,601 | 9/1976 | Arai | 404/68 |
| 4,007,994 | 2/1977 | Brown | 404/69 |

*Primary Examiner*—Nile C. Byers

[57] ABSTRACT

An expansion joint seal assembly for sealing the gap between adjacent sections of a deck structure, such as a highway bridge or parking deck. The assembly includes an elongated body of elastomeric material that has two elongated compression pads extending along each side, and a flexible sealing section joining the two pads together. The compression pads are secured to the roadbed sections on opposite sides of the gap by means of metal cover plates that extend over ribs on the top of each compression pad, and fasteners such as anchor bolts that are secured to the deck sections at points in between the ribs of the compression pads. The anchor bolts extend up through the cover plates, and the heads of the anchor bolts are tightened down against the cover plates to press them against the compression pads and secure the compression pads in firm sealing engagement with the deck sections.

5 Claims, 3 Drawing Figures

EXPANSION JOINT SEAL ASSEMBLY

FIELD OF THE INVENTION

This invention relates generally to seals that are used to cover the gaps between sections of a deck structure, such as a highway bridge or parking deck. These gaps allow for expansion of the deck sections, and the seals that are used to cover them are commonly referred to as "expansion joints" or "expansion joint seals." More particularly, the invention relates to an expansion joint seal assembly that is secured in an improved manner to the deck sections on either side of the joint.

BACKGROUND OF THE INVENTION

The seal that is placed over the expansion gap between the sections of a deck structure is designed to keep foreign substances such as debris, water, and chemicals from falling into the gap. Such foreign substances can cause spalling and damage to the deck substructure, especially when they clog up the gap so much that they interfere with the normal expansion of the deck sections. To keep these foreign substances out, it is very important that the seal be fixed in firm sealing engagement with both adjacent deck sections throughout the entire length of the seal.

Vertical fasteners, spaced along the length of the seal, are usually employed to clamp the seal in firm sealing engagement with each deck section. Various types of fasteners may be used, such as a pin embedded in the deck section, with a nut threaded on the pin above the seal, or a collar embedded in the deck section, into which is threaded an anchor bolt having a head used to clamp the seal in place. In this application, the term "anchor bolt" will be used in a broad sense to refer to any of these possible fastening means that are mechanical equivalents of an anchor bolt.

Expansion joint seals are often prone to being loosened or separated from the deck sections to which they are secured. One reason for such problems is that a flat metal plate is often employed under the heads of the seal's anchor bolts to distribute the forces exerted by these bolts across the entire length and width of the seal. This flat metal plate may tend to flex upwardly in some places, causing the adjacent elastomeric portion of the seal to flex upwardly as well.

Another possible reason for the seal loosening is that the heads of the seal's anchor bolts are often tightened against a plate resting on the resilient compression pad of the seal. In such seal assemblies, each anchor bolt is likely to be tightened to a different degree, at least to some extent. This is because of the variations in the elastomeric material and in the surfaces of the deck sections (i.e., high and low spots or voids). Too much tightening of an anchor bolt can cause the seal to lift up in areas that are spaced from but are near the anchor bolt, while too little tightening will of course cause leaking in the immediate area of the anchor bolt.

There are some seals that are clamped to the deck sections by anchor bolts located beyond the lateral edges of the seal and plates that are secured by the anchor bolts and extend from the anchor bolts over the edges of the seal. Examples of such cantilever-type clamping plates are shown in U.S. Pat. No. 3,713,368 to McDowell et al., and an advertisement of a seal assembly manufactured by Fel-Pro, Incorporated on page 7 of the December 1976 issue of Civil Engineering ASCE. The anchor bolts of these seals are tightened against solid metal plates that are in direct contact with the deck sections, so that a workman installing the seal can properly tighten each anchor bolt. However, these metal plates are secured to the deck sections on one side only, and are prone to rocking about their connections with the anchor bolts. With the repeated impacts of the wheels of passing traffic, these plates tend to rock loose and release the tight engagement between the seal and the deck sections.

SUMMARY OF THE INVENTION

It is an object of the present invention to solve the foregoing problems of prior expansion joint seals, and to provide a novel expansion joint seal assembly that has an improved, more stable clamping arrangement than previous seal assemblies and distributes the load of the clamping bolts more evenly over the entire area between the seal and the deck sections.

In accordance with the invention, an expansion joint seal assembly is provided which includes an elongated body of elastomeric material having two elongated compression pads extending along each of its sides. An elongated flexible sealing section is connected between each of these compression pads. Each of the compression pads is designed to be placed on one of the deck sections, with the flexible sealing section spanning the gap between the deck sections. Each of the compression pads has two spaced apart, upwardly extending longitudinal ribs on the top side of the pad. Between these ribs are located one or more metal insert members that extend through the compression pads.

There is also provided at least one metal cover plate over the top of each of the compression pads. Each cover plate extends over both ribs of its associated compression pad, as well as over the metal insert member or members located between these ribs. A fastener, such as a threaded anchor bolt, is secured to one of the deck sections and extends up through holes in the metal insert member and the metal cover plate. The anchor bolt has a head located above the metal cover plate, and this head is tightened against the metal cover plate to press the cover plate down against the ribs of the compression pad. With the cover plate being drawn downwardly in its middle and resting firmly on either side on the ribs of the compression pad, the cover plate is secured firmly to the compression pad, the tension load in the anchor bolt is distributed by the cover plate over a wide area of the compression pad, and the pad is thus secured in firm sealing engagement with the deck section.

In addition to distributing the tightening force of the anchor bolts, the metal cover plates also serve the function of protecting the elastomeric compression pads against damage by heavy or sharp objects, including snowplow blades.

These and other objects, advantages and features of the invention will be more apparent from the following detailed description of our invention and the attached drawings.

DESCRIPTION AND DRAWINGS OF A PREFERRED EMBODIMENT

Figure 1:
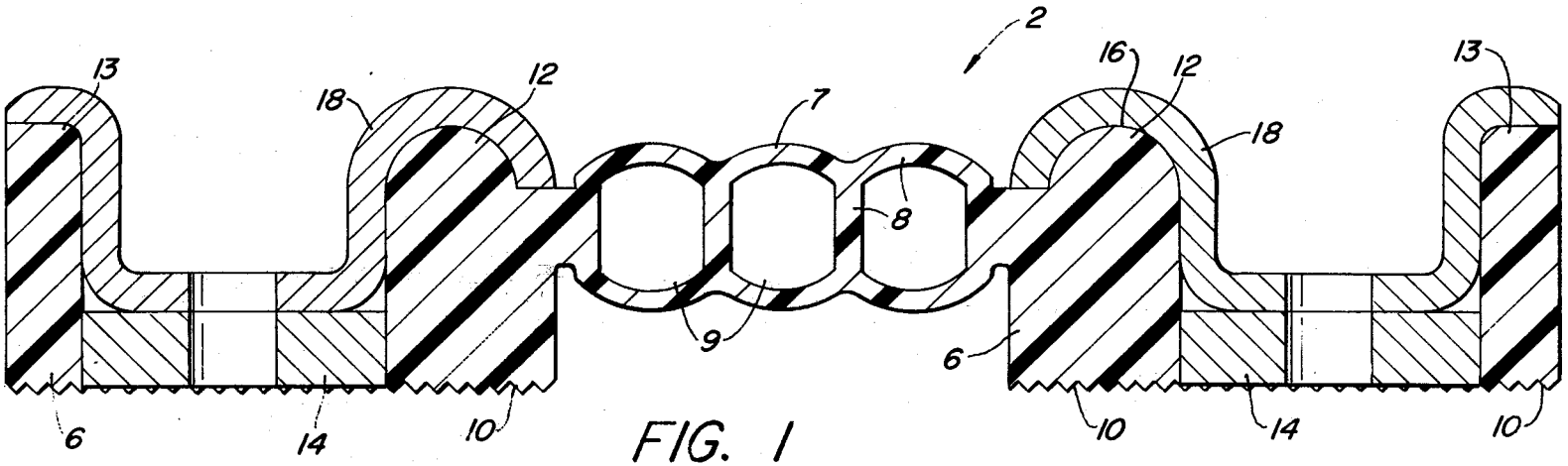
FIG. 1 is a cross-section of an expansion joint seal assembly made in accordance with the invention, and prior to being installed on adjacent deck sections over an expansion gap to be sealed.

Referring to FIG. 1, an expansion joint seal assembly 2 has an elastomeric body 4 with two compression pads 6 on either side of a flexible sealing section 7.

The walls of the sealing section 7 are preferably relatively thin compared to the much thicker compression pads 6, so that the sealing section 7 exerts very little lateral force against the compression pads 6 when the seal is compressed. In the present embodiment, the walls 8 of the sealing section 7 are formed in the shape of cells 9, so that even if the top walls of the cells 9 are punctured, the bottom walls of the cells will prevent particles or liquids from leaking into the gap beneath the seal. Alternatively, however, the sealing section 7 may be of any other form, including a single flexible membrane.

The compression pads 6 preferably have grooved or roughened bottom surfaces 10 that are designed for placement on deck sections adjacent a gap to be sealed.

On the top side of each compression pad 6 are two upwardly extending ribs 12 and 13. As will be seen in the top view of FIG. 3, the compression pads 6 with their ribs 12 and 13, as well as the sealing section 7, are of an elongated form extending the length of the elongated elastomeric body 4. All of these elongated parts of the seal assembly 2 may be extruded to any length, to fit the length of the expansion gap to be sealed.

Between the ribs 12 of each of the compression pads 6, the elastomeric material is interrupted by metal insert plates 14. These insert plates 14 are spaced along the length of each compression pad, wherever it is desired to place an anchor bolt for securing the seal assembly. A typical spacing for the plates 14 might be thirty centimeters, with the insert plates 14 themselves each being eight centimeters in length. The plates 14 are preferably rectangular in plan view, as can be seen by their dotted line representations in FIG. 3. The plates 14 are inserted into the compression pads 6 through holes of substantially the same size and shape. The bottom surfaces of the insert plates 14 are designed to be flush with the bottom surfaces 10 of the compression pads 6.

Each of the ribs 12 nearest the flexible sealing section 8 preferably have rounded top surfaces 16. Metal cover plates 18 are placed over the tops of the compression pads 6, with the contours of the plates 18 preferably shaped to fit closely with the contours of the tops of the compression pads 6. If the ribs 12 have rounded top surfaces 16, the plates 18 should be likewise rounded above the ribs 12, and indented downwardly in the areas between the ribs 12 and 13.

Figure 3:
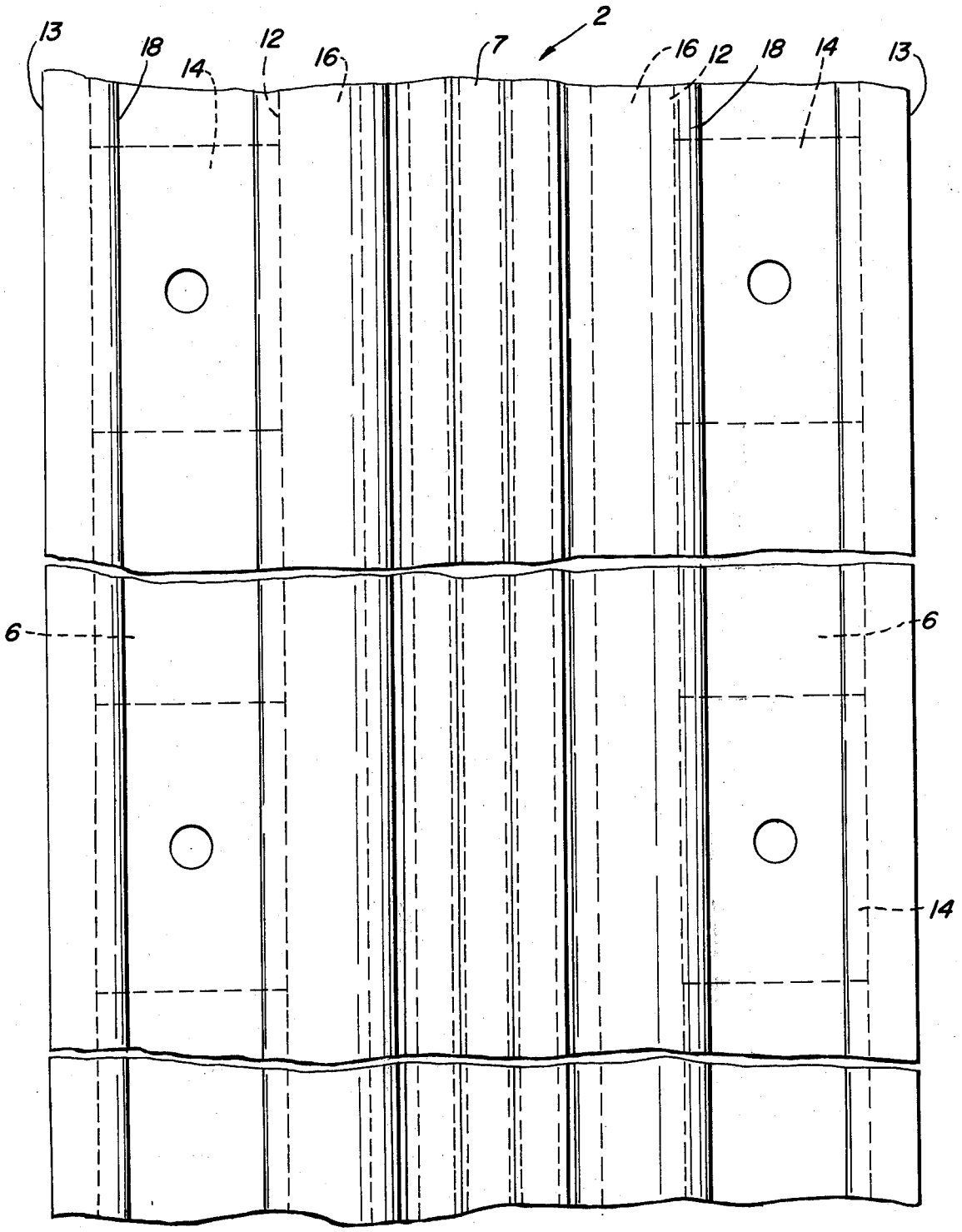
FIG. 3 is a top plan view of the expansion joint seal assembly of FIG. 1, with parts of the seal between the anchoring means of the assembly being broken away.
Figure 1:
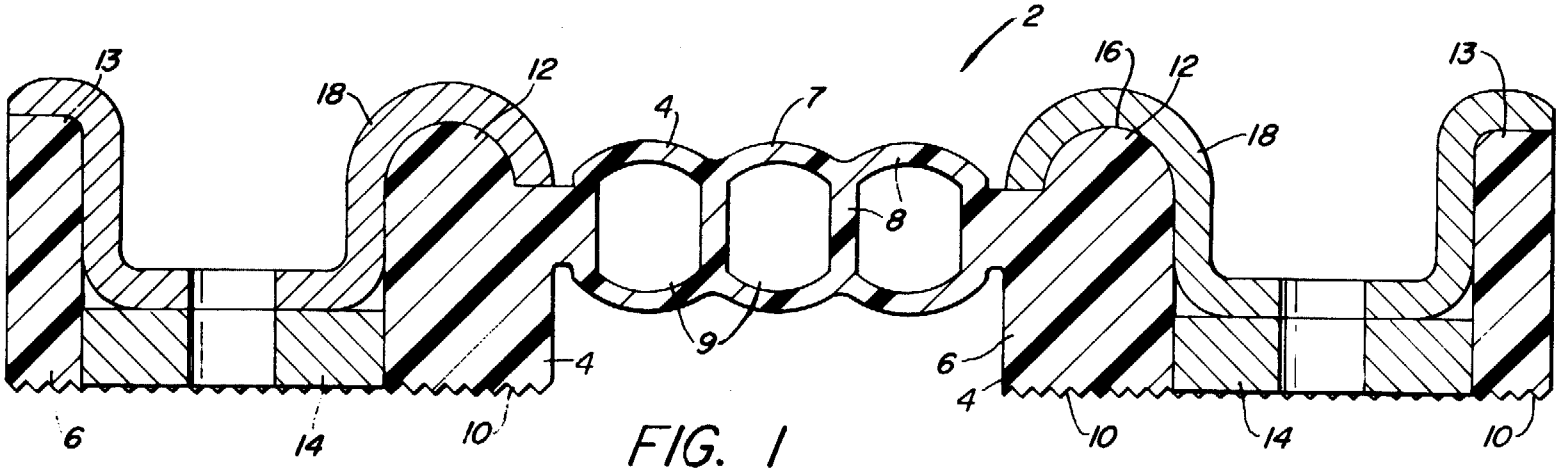

As seen in FIG. 3, the metal cover plates 18 are elongated like the compression pads 6 which they cover. The cover plates 18 may be of any length, but it has been found convenient to make them in separate sections each of about three to four meters in length. The cover plates 18 on each compression pad 6 are placed in butting, end-to-end relation to each other, and all of the plates 18 on each compression pad 6 together form a continuous metal covering for the compression pad that protects the pad from damage from sharp objects, as well as helping to secure the pad to the deck adjacent the expansion gap.

Figure 2:
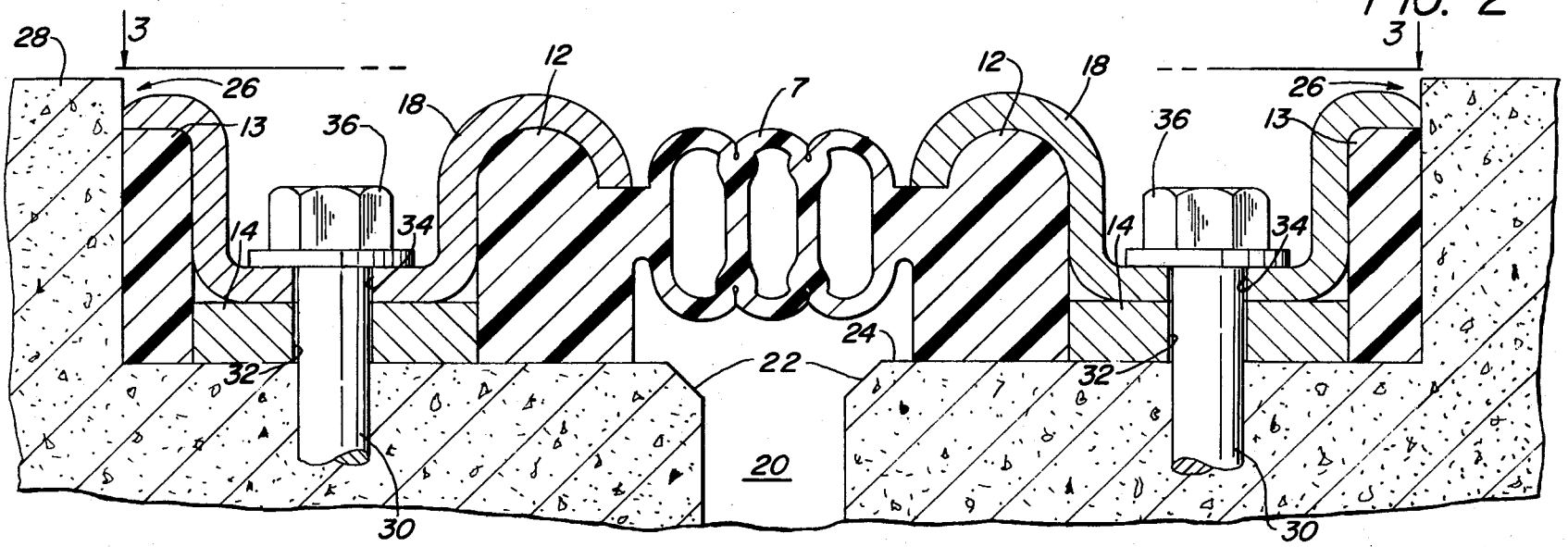
FIG. 2 is a cross-section of the expansion joint seal assembly of FIG. 1, after its installation on adjacent deck sections over an expansion gap to be sealed.

The expansion joint seal assembly 2 is shown installed over an expansion gap 20 in FIG. 2 between two adjacent deck sections 22. The seal assembly 2 preferably sits on the bottom surfaces 24 of recesses 26 in the edges of the deck sections facing the gap 20. This allows the top of the seal assembly 2 to be stationed slightly below the top surfaces 28 of the deck sections, so that passing traffic can travel easily over the metal cover plates 18.

The seal assembly 2 is secured to the deck sections 22 preferably with the flexible sealing section 7 compressed as shown in FIG. 2. Fasteners such as anchor bolts 30 are used to secure the seal assembly to the deck sections. The anchor bolts 30 are threaded into the deck sections 22 by means of internally threaded, embedded collars or equivalent securing means, not shown. The anchor bolts 30 extend upwardly from the deck sections 22 through holes 32 in the metal insert members 14 and holes 34 in the metal cover plates 18.

When the anchor bolts 30 are tightened, heads 36 on the anchor bolts 30 hold the cover plates 18 pressed against the ribs 12 and 13 of compression pads 6. The cover plates 18 are preferably indented between the ribs 12 and 13 to such an extent that they touch the metal insert plates 14 when the anchor bolts 30 are tightened to exert the right amount of pressure between the plates 18 and the ribs 12 and 13. With the anchor bolts 30 so tightened and the metal cover plates 18 resting firmly on either side on the ribs 12 and 13 of the compression pads 6, the cover plates 18 transmit the tension loads in the anchor bolts 30 across to the ribs 12 and 13 on either side of the compression pads 6. From the ribs 12 and 13, the loads exerted by the anchor bolts 30 are distributed over the entire base surfaces 10 of the compression pads 6 to secure the pads in firm sealing engagement with the deck sections 22.

It will thus be seen that the expansion joint seal assembly 2 provides a more stable clamping arrangement than previous seal assemblies, because it employs a metal clamping plate 18 that is supported on both sides by compression pad ribs 12 and 13, while being held down in the center by anchor bolts 30. Also, the heads 36 of the anchor bolts 30 are tightened firmly against the centers of metal cover plates 18, which are in direct engagement with metal insert plates 14. In turn, the metal insert plates 14 are in direct engagement with the deck sections 22, so that the anchor bolts 30 are automatically tightened the proper amount when the heads 36 bring the metal cover plates into engagement with the insert plates 14. In addition, because metal cover plates 18 are formed in a shape resembling a channel in order to conform to the shape of the top surfaces of the compression pads 6, the plates 18 are not as prone to longitudial flexing as the more conventional flat plates used to reinforce expansion joint seals.

While we have thus shown and described one embodiment of our invention, other embodiments and modifications will be course be possible while remaining within the scope of the appended claims.

We claim:

1. An expansion joint seal assembly for sealing the gap between adjacent deck sections, comprising:

a. an elongated body of elastomeric material having two elongated compression pads extending along each side of said elongated body and an elongated flexible sealing section connected between said compression pads, each of said compression pads being designed for placement on one of said deck sections on the opposite side of said gap from the other of said compression pads, with said flexible sealing section spanning said gap, b. each of said compression pads having a bottom surface designed for sealing engagement with the deck section on which the pad is placed, and also having two spaced apart, upwardly extending longitudinal ribs on the topside of the pad, c. at least one metal insert member extending through each of said compression pads between said longitudinal ribs, d. at least one metal cover plate placed on top of each said compression pads, each of said cover plates extending over the ribs of its associated compression pad and over the metal insert member located between said ribs, e. a fastener designed to be secured to said deck section and extending up through holes in said metal insert member and said metal cover plate, said fastener having means for holding said metal cover plate pressed against said ribs of said compression pad to secure said compression pad to said deck section, with said bottom surface of said compression pad in firm sealing engagement with said deck section.

2. A roadbed expansion joint seal assembly according to claims 1 wherein the tops of said metal cover plates are shaped so as to contact said metal insert members when said metal cover plates are tightened by said fasteners against said ribs to secure said compression pads to said deck sections.

3. A roadbed expansion joint seal assembly according to claim 2 wherein the tops of said metal insert members are below the tops of said ribs of said compression pads are secured to said deck sections, and said metal cover plates are indented downwardly between said ribs in the areas where said plate contacts said metal insert members, thereby forming recesses in said metal cover plate for housing the top portions of said fasteners.

4. A roadbed expansion joint seal assembly according to claims 3 wherein the rib of each of said compression pads nearest said flexible sealing section has a rounded top surface and each of said metal cover plates has curved side portion that conform to the curvature of said rounded top surface of said rib.

5. A roadbed expansion joint seal assembly according to claim 1 wherein the bottom surfaces of said compression pads have ridges and grooves that increase the sealing engagement of said pads with said deck section.

* * * * *

UNITED STATES PATENT OFFICE

CERTIFICATE OF CORRECTION

Patent No. 4,063,840 Dated December 20, 1977

Inventor(s) Gary L. Fordyce et al.

It is certified that error appears in the above-identified patent and that said Letters Patent are hereby corrected as shown below:

Figure 1, should appear as shown on the attached sheet.

Claim 3, line 7, "plate" should read -- plates --.

Signed and Sealed this

Sixteenth Day of May 1978

[SEAL]

Attest:

RUTH C. MASON
Attesting Officer

LUTRELLE F. PARKER
Acting Commissioner of Patents and Trademarks